US005090874A

United States Patent [19]

Aikawa et al.

[11] Patent Number: 5,090,874

[45] Date of Patent: Feb. 25, 1992

[54] FLUID COMPRESSOR

[75] Inventors: Eiichi Aikawa, Yokohama; Takayoshi Fujiwara, Kawasaki; Hisanori Honma, Yokohama; Yoshinori Sone, Yokohama; Moriaki Shimoda, Yokohama, all of Japan

[73] Assignee: Kabushiki Kaisha Toshiba, Kawasaki, Japan

[21] Appl. No.: 535,563

[22] Filed: Jun. 11, 1990

[30] Foreign Application Priority Data

Jun. 30, 1989 [JP] Japan ..... 1-166887
Sep. 8, 1989 [JP] Japan ..... 1-233409

[51] Int. Cl.[5] ..... F04C 18/00
[52] U.S. Cl. ..... 417/356; 418/220
[58] Field of Search ..... 417/356; 418/188, 220

[56] References Cited

U.S. PATENT DOCUMENTS 2,401,189 5/1946 Quiroz .
4,871,304 10/1989 Iida et al. .

FOREIGN PATENT DOCUMENTS 64-36990 2/1989 Japan .
2-19684 1/1990 Japan ..... 418/220

*Primary Examiner*—Gerald A. Michalsky
*Attorney, Agent, or Firm*—Cushman, Darby & Cushman

[57] ABSTRACT

A fluid compressor includes a cylinder having first and second discharge ends, in which a rotating rod is rotatably arranged. First and second spiral grooves are formed on the outer circumference of the rod, and first and second spiral blades are fitted into the grooves. The first groove has a first starting end located in the middle portion of the rod, and extends from the starting end toward the first discharge end. The second groove has a second starting end located in the middle portion of the rod, and extends from the second starting end toward the second discharge end. The first and second starting ends are set apart from each other by a certain angle in the circumferential direction of the rod. Operating fluid is introduced into the middle portion in the cylinder, and fed to the first and second discharge ends of the cylinder through operating chambers defined by the first and second blades in the cylinder.

12 Claims, 2 Drawing Sheets

FLUID COMPRESSOR

BACKGROUND OF THE INVENTION

1. Field of Invention

The present invention relates to a fluid compressor and more particularly, to a compressor for compressing refrigerant gas in a refrigeration cycle, for example.

2. Description of the Related Art

A fluid compressor disclosed in U.S. Pat No. 4,871,304 (filed on July 11, 1988 by the Applicant of the present invention), for example, is well known. The compressor of this type has a compression section driven by a motor and arranged in the closed case. The compression section is provided with a cylinder rotated together with a rotor in the motor. A piston having a center axis eccentric to the axis of the cylinder is rotatably 15. housed in the cylinder. A spiral groove is formed on the outer circumference of the piston, extending from one end to the other end of the piston in the axial direction thereof, and pitches of this spiral groove are gradually narrowed with distance from one end to the other end of the piston. A blade having appropriate elasticity is fitted into the spiral groove.

A space between the cylinder and the piston is partitioned into a plurality of operating chambers by the blade. The volumes of these operating chambers are gradually decreased with distance from the suction side to the discharge side of the cylinder. When the cylinder and the piston are rotated by the motor, synchronizing with each other, refrigerant gas in the refrigeration cycle is sucked into the operating chambers through the suction side of the cylinder. The gas thus sucked is successively fed to the operating chambers located on the discharge side of the cylinder while being compressed in these operating chambers, and then discharged into the closed case through the discharge end of the cylinder.

In the above-described compressor, however, the pressure of the refrigerant gas in the operating chamber located on the discharge side of the cylinder is higher, as compared with that of the gas in the operating chamber located on the suction side of the cylinder. Therefore, thrust force acts on the piston, heading from the discharge side to the suction side of the cylinder, to thereby increase friction between the piston and bearings. A large drive force is thus needed to rotate the cylinder and piston.

In order to solve this problem, applicants of the present invention propose another compressor in a Japanese Pat. application No 63-170693.

According to this second compressor, the piston has two spiral grooves extending from the center to both ends thereof. A blade is fitted into each of the spiral grooves. Refrigerant gas is sucked into the cylinder through the center portion of the cylinder in the axial direction thereof, fed, while being compressed in two directions or toward both ends of the cylinder, and discharged into the closed case through these ends of the cylinder.

This compressor has the following advantages. The refrigerant gas is transferred and compressed in two directions which are opposite to each other. Therefore, thrust forces which act on the piston from both ends to the center of the cylinder cancel each other out. In addition, this compressor enables stress, which acts on the blades, to be made smaller, as compared with those compressors which have a piston provided with a single spiral groove thereon and which has the same compression capacity as the above-described second compressor.

The load torque of the compressor usually changes, drawing a sine curve, as the piston rotates. Its discharge pressure also pulsates, drawing a sine curve, as the piston rotates. In the case of the compressor in which the refrigerant gas is fed, while being compressed, in two directions, both the variation in the load torque and that in the discharge pressure are about two times greater than those in the compressor in which the refrigerant gas is fed, while being compressed, only in one direction. When the load torque and discharge pressure vary largely in this manner, vibration, noise, and the like of the compressor are increased.

In order to increase the capacity of the compressor while making us of the merits available from the compressor of such type that feeds the refrigerant gas in two directions, it is therefore desired that the variation in the load torque and discharge pressure of the compressor can be reduced to a greater extent.

SUMMARY OF THE INVENTION

The object of the present invention is to provide a compact fluid compressor capable of decreasing thrust force acting on a rotating body to reduce the variation in the load torque and discharge pressure of the compressor.

In order to achieve the object, a fluid compressor according to the present invention comprises a cylinder having first and second discharge ends; a columnar rotating body arranged in the cylinder in the axial direction thereof and being eccentric to the center axis thereof, and rotatable while part of the rotating body is in contact with the inner circumferential surface of the cylinder, said rotating body having first and second spiral grooves on its outer circumference, said first spiral groove having a first starting end located substantially in the middle of the rotating body in the axial direction thereof, extending from the first starting end toward the first discharge end of the cylinder and having pitches gradually narrowed with distance from the first starting end to the first discharge end of the cylinder, while said second spiral groove having a second starting end located substantially in the middle of the rotating body in the axial direction thereof, extending from the second starting end toward the second discharge end of the cylinder and having pitches gradually narrowed with distance from the second starting end toward the second discharge end, said first and second spiral grooves being turned in directions opposite to each other, and said first and second starting ends being set apart from each other by a certain angle in the circumferential direction of the rotating body; first and second spiral blades fitted into the first and second grooves to be slidable in the radial direction of the rotating body, having outer circumferential surfaces closely in contact with the inner circumference of the cylinder, and 15. dividing the space between the inner circumference of the cylinder and the outer circumference of the rotating body into a plurality of operating chambers; means for guiding operating fluid into that area of the space which is adjacent to the first and second starting ends of the first and second spiral grooves; and means for rotating the rotating body synchronously with the cylinder so as to feed the operating fluid, introduced into said area through the guide means, to the first and second discharge ends of the cylinder through the operating chambers and to discharge the fluid outside through these discharge ends of the cylinder.

According to the compressor having the above-described arrangement, the operating fluid introduced into the cylinder is fed, while being compressed, in two directions opposite to each other, and then discharged outside through the first and second discharge ends of the cylinder. Thrust forces, which act on the rotating body from both ends to the center of the body, are therefore balanced with each other.

The load torque and discharge pressure, which are generated by the compressed fluid being discharged from the first discharge end of the cylinder, change periodically. The load torque and discharge pressure, which are generated by the compressed fluid being discharged from the second discharge end of the cylinder, change in the same way, but in different phase since the starting ends of the first and second spiral grooves are set apart from each other. Therefore, variations in the discharge pressure and the load torque of the compressor, which are the sum of the discharge pressures and the load torques at the first and second discharge ends, are smaller than in the case where discharge pressures and load torques change in the same phase, respectively.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 through 6 show a fluid compressor according to an embodiment of the present invention, in which.

FIG. 1 is a longitudinal-sectional view showing the whole of the compressor;

FIG. 2 is a side view showing a rotating rod of the compressor;

FIG. 3 is a side view showing the rotating rod rotated by 180° from the state shown in FIG. 2;

FIG. 4 is a sectional view taken along a line IV—IV in FIG. 1;

FIG. 5 is a sectional view showing a cylinder and the rotating rod rotated by 90° from the state shown in FIG. 4; and FIG. 6 shows a graph showing the characteristics of change in the load torque and discharge pressure of the compressor.

DETAILED DESCRIPTION OF THE PREFERRED EMBODIMENT

An embodiment of the present invention will now be described with reference to the accompanying drawings.

Figure 1:
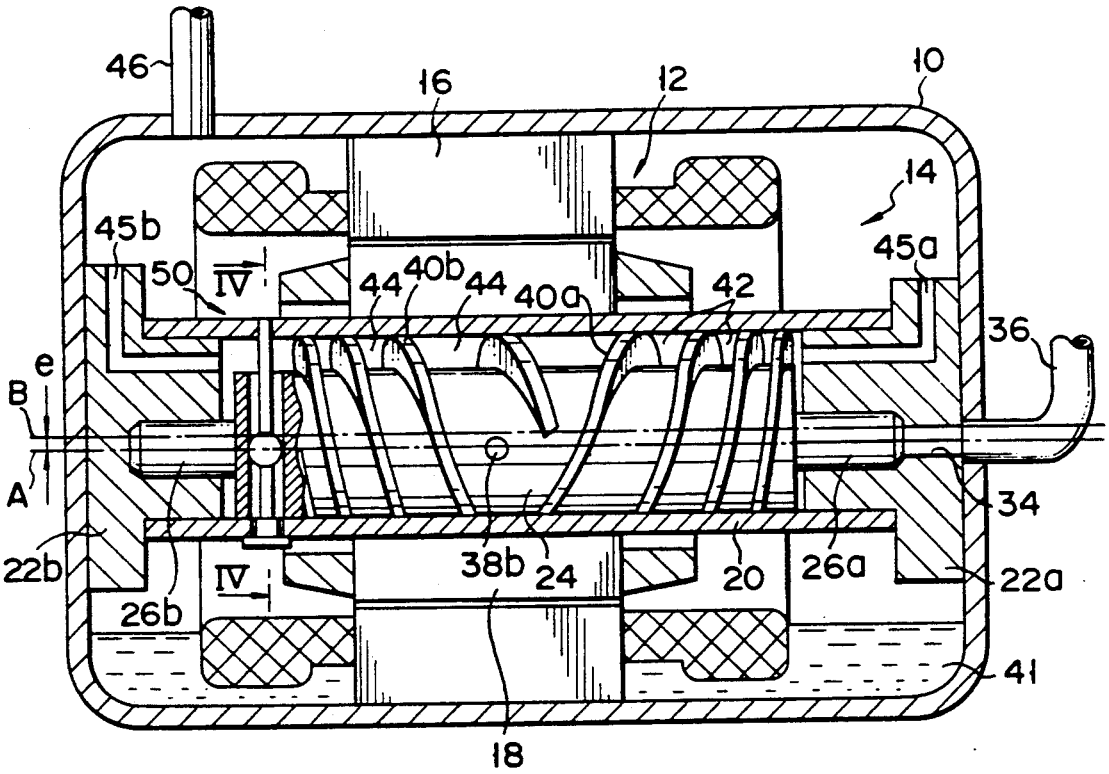

FIG. 1 shows an embodiment to which the present invention is applied to a closed type compressor for compressing a refrigerant in a refrigerating cycle.

The compressor includes a closed case 10, and motor and compression sections 12 and 14 arranged in the case 10. The motor section 12 includes a ring-shaped stator 16 fixed to the inner face of the case 10 and a ring-shaped rotor 18 located inside the stator 16.

The compression section 14 has a cylinder 20, and the rotor 18 is coaxially fixed to the outer circumference of the cylinder 20. Both ends of the cylinder 20 are air tightly closed and rotatably supported by bearings **22*a* and 22*b* fixed to the inner face of the case 10. More specifically, the right end or first discharge end of the cylinder 20 is rotatably fitted onto the bearing 22*a*, while the left end or second discharge end thereof is rotatably fitted onto the bearing 22*b*. The cylinder 20 and the rotor 18 fixed thereto are therefore supported, coaxial to the stator 16, by the bearings 22*a* and 22*b***.

A columnar rotating rod 24 having a diameter smaller than that of the cylinder 20 is arranged in the cylinder and extends between the bearings **22*a* and 22*b*. The rotating rod 24 has a center axis A made eccentric to that B of the cylinder 20 by a distance e. Part of the outer circumference of the rod 24 is in contact with the inner circumference of the cylinder 20. Smaller-diameter portions 26*a* and 26*b* at both ends of the rotating rod 24 are rotatably supported by the bearings 22*a* and 22*b***.

The cylinder 20 and the rotating rod 24 are connected to each other through an Oldham's mechanism 50 which serves as rotational force transmitting means as will be described later. When the motor section 12 is energized to rotate the cylinder 20 together with the rotor 18, therefore, the rotational force of the cylinder 20 is transmitted to the rod 24 by means of the Oldham's mechanism 50. As a result, the rod 24 is rotated in the cylinder 20 while the outer circumference thereof is partially in contact with the inner circumference of the cylinder 20.

Figure 2:
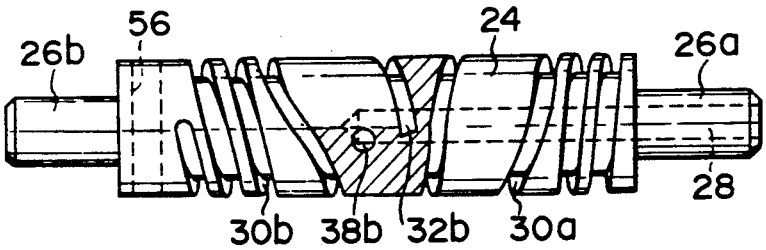
Figure 3:
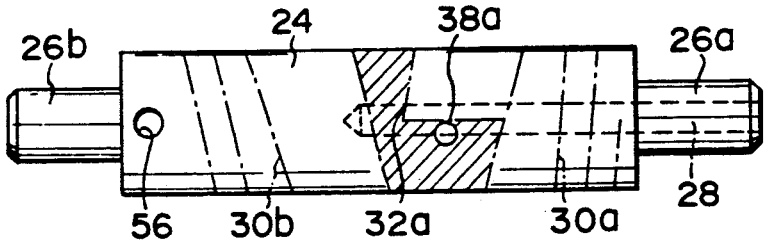

As shown in FIGS. 2 and 3, a first groove **30*a* is formed on the outer circumference of the rotating rod 24, extending from the middle portion of the rod to the right end thereof, while a second groove 30*b* is also formed on the rod 24, extending from the middle portion of the rod to the left end thereof. The pitches of the first groove 30*a* gradually become narrower at a certain rate with distance from the middle portion of the rod 24 to the right end thereof or to the first discharge end of the cylinder 20. The pitches of the second groove 30*b* gradually become narrower at the certain rate with distance from the middle portion of the rod 24 to the left end thereof or to the second discharge end of the cylinder 20. The first groove 30*a* has same turns as that of the second groove 30*b*, but the first groove 30*a* is turned in a direction opposite to that direction in which the second groove 30*b* is turned. FIG. 3 schematically shows the rod 24** rotated about its center axis by 180° from the state shown in FIG. 2.

The first and second grooves **30*a* and 30*b* have starting ends 32*a* and 32*b* positioned near the middle of the rod 24. The starting ends 32*a* and 32*b* are set apart from each other by 180° in the circumferential direction of the rod 24. Further, the starting end 32*a* is set apart from the starting end 32*b* in the axial direction of the rod 24 and particularly the starting end of one of the groove 30*a* and 30*b* is positioned so adjacent to the other groove as not to cross the latter. Either groove has width and depth which are uniform all over its length, and the side faces of the groove are perpendicular to the longitudinal axis of the rod 24**.

The rotating rod 24 has a suction passage 28 therein, which extends from the right end of the smaller-diameter portion 26*a* to the middle of the rod 24. The right end of the suction passage 28 communicates with a suction tube 36 of the refrigerating cycle through a suction hole 34 bored in the bearing 22*a*. The left end of the suction passage 28 communicates with first and second suction ports 38*a* and 38*b* which are opened at the outer circumference of the middle portion of the rotating rod 24. The first suction port 38*a* is positioned between the starting end 32*a* of the first groove 30*a* and the terminal end of the first turn thereof. Similarly, the second suction port 38*b* is positioned between the starting end 32*b* of the second groove 30*b* and the terminal end of the first turn thereof. The suction ports 38*a* and 38*b* may be formed in a hatched area on the outer circumference of the rod 24 or in the area thereon which is enclosed by the first turns of the first and second grooves 30*a* and 30*b*. One of the suction ports may be omitted.

First and second spiral blades 40*a* and 40*b* shown in FIG. 1 are fitted into the grooves 30*a* and 30*b*, respectively. The blades 40*a* and 40*b* are formed of elastic material, and can be fitted into their corresponding grooves by ulilizing their elasticity. The thickness of each blade is substantially equal to the width of the corresponding groove. Each portion of each blade is movable in the radial direction of the rod 24 along the corresponding groove. The outer circumference of each of the blades 40*a* and 40*b* is closely in contact with the inner circumference of the cylinder 20.

The space defined between the inner circumference of the cylinder 20 and the outer circumference of the rod 24, extending from the middle of the cylinder 20 to the first discharge side thereof, is partitioned into a plurality of operating chambers 42 by the first blade 40*a*, as shown in FIG. 1. Each of the operating chambers 42 is defined by two adjacent turns of the blade 40*a* and substantially in the form of a crescent, extending along the blade 40*a* from the contact portion between the rod 24 and the inner circumference of the cylinder 20 to the next contact portion. The volumes of these operating chambers 42 are reduced gradually with distance from the middle of the cylinder 20 toward the first discharge side thereof.

Similarly the space defined between the inner circumference of the cylinder 20 and the outer circumference of the rod 24, extending from the middle of the cylinder 20 to the second discharge side thereof, is partitioned into a plurality of operating chambers 44 by the second blade 40*b*. Each of the operating chambers 44 is defined by two adjacent turns of the blade 40*b* and substantially in the form of a crescent, extending along the blade 40*b* from a contact portion between the rod 24 and the inner circumference of the cylinder 20 to the next contact portion. The volumes of these operating chambers 44 are reduced gradually with distance from the middle of the cylinder 20 toward the second discharge end thereof.

shown in FIG. 1, discharge holes 45*a* and 45*b* are formed in the bearings 22*a* and 22*b*, respectively. One end of the discharge hole 45*a* is opened into the first discharge end of the cylinder 20 while the other end thereof is opened into the case 10. One end of the discharge hole 45*b* is opened into the second discharge end of the cylinder 20 while the other end thereof is opened into the case 10. These discharge holes 45*a* and 45*b* may be formed in the cylinder 20.

Reference numeral 46 in FIG. 1 represents a discharge tube communicating with the interior of the case 10.

Figure 4:
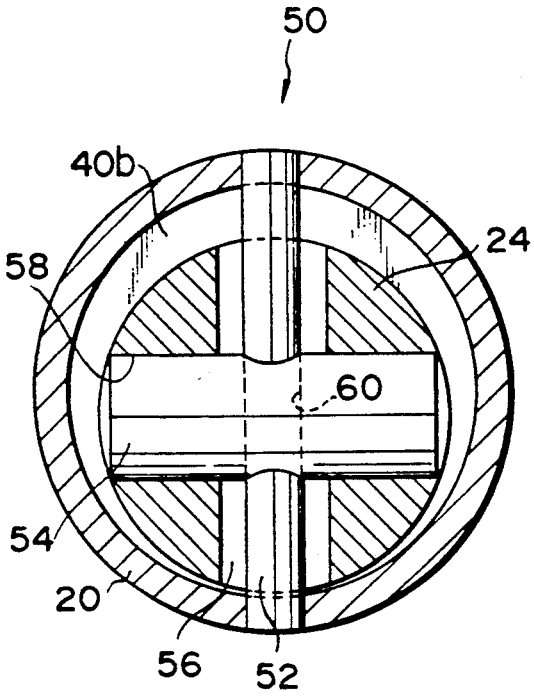
Figure 5:
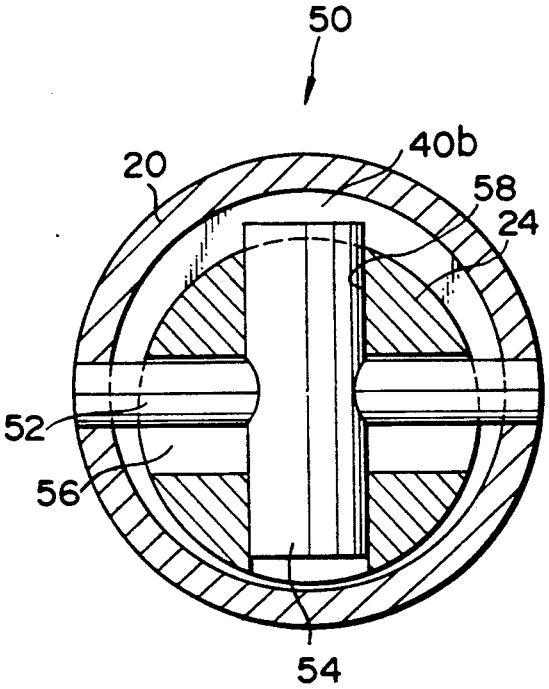

As shown in FIGS. 1, 4 and 5, the Oldham's mechanism 50 includes an Oldham's pin 52 which serves as a first pin member and an Oldham's slider 54 which serves as a second pin member.

The Oldham's pin 52 is columnar, having the same diameter over its entire length. This pin 52 is arranged in the cylinder 20 in the radial direction thereof and both ends of the pin 52 are fixed to the cylinder 20. The pin 52 can rotate therefore together with the cylinder 20 around the center axis B thereof which is perpendicular to the pin 52. Further, the pin 52 passes loosely through a through-hole 56 which extends through the rotating rod 24 in the radial direction thereof. The diameter of the through-hole 56 is larger by 2*e* than that of the Oldham's pin 52, where e represents the distance by which the center axis A of the rotating rod 24 is made eccentric to the center axis B of the cylinder 20.

The Oldham's slider 54 is columnar, having a same diameter over the whole length of it, which diameter is larger than that of the Oldham's pin 52. The slider 54 is slidably inserted into a slide hole 58 which extends through the rotating rod 24 in the radial direction thereof. The slide hole 58 extends perpendicular to the through-hole 56. Further, a through-hole 60 is formed in the slider 54 at the intermediate portion thereof, extending perpendicular to the axis of the slider 54. The Oldham's pin 52 is slidable inserted into the through-hole 60 and extends perpendicular to the slider 54. The Oldham's slider 54 is slidably therefore in the slide hole 58 in its axial direction and movable relative to the Oldham's pin 52 in the axial direction of the pin 52.

The following is a description of the operation of the compressor constructed in this manner.

When the motor section 12 is switched on, the rotor 18 rotates together with the cylinder 20. The rotational force of the cylinder 20 is transmitted to the rotating rod 24 through the Oldham's mechanism 50, rotating the rod 24 synchronizing with the cylinder 20. More specifically, Oldham's pin 52 is rotated integral with the cylinder 20, and the Oldham's slider 54 is also rotated together with the pin 52 while being kept perpendicular to the pin 52. As shown in FIGS. 4 and 5, the Oldham's pin 52 and slider 54 slide relative to each other while being kept perpendicular to each other. The slider 54 slides in the slide hole 58 in its axial direction while the pin 52 moves in the through-hole 56 in the radial direction thereof. The rotational force of the cylinder 20 is thus transmitted to the rotating rod 24 by means of the Oldham's pin 52 and slider 54, and the rod 24 is rotated about the center axis A thereof. The rotating rod 24 is rotated in this manner, synchronizing with the cylinder 20 while its outer circumference is partially in contact with the inner circumference of the cylinder 20. The first and second blades 40*a* and 40*b* are also rotated together with the rod 24.

The blades 40*a* and 40*b* rotate while keeping their outer circumferences in contact with the inner circumference of the cylinder 20. Therefore, they are pushed into the corresponding grooves 30*a* and 30*b* as they approach each contact portion between the outer circumference of the rod 24 and the inner circumference of the cylinder 20, and emerge from the grooves as they go away from the contact portion. When the compression section 14 is made operative, refrigerant gas is sucked into the cylinder 20, passing through the suction tube 36, suction hole 34, suction passage 28, and first and second suction ports 38*a* and 38*b*. This gas is confined in the operating chamber 42 defined between the first and second turns of the first blade 40*a* and in the operating chamber 44 defined between the first and second turns of the second blade 40*b*. As the rod 24 rotates, the gas in the operating chamber 42 is successively fed into the next operating chamber 42 while being confined between the two adjacent turns of the blade 40*a*. Similarly, the gas in the operating chamber 44 is successively fed into the next operating chamber 44 while being confined between the two adjacent turns of the blade 40*b*. The volumes of the operating chambers 42 are gradually reduced with distance from the middle of the cylinder 20 to the first discharge end thereof, while the volumes of the operating chambers 44 are gradually reduced with distance from the middle of the cylinder 20 to the second discharge end. Therefore, the gas confined in the operating chamber 42 is gradually compressed as it is delivered to the first discharge end of the cylinder 20, while the gas confined in the rotating chamber 44 is gradually compressed as it is delivered to the second discharge end of the cylinder 20. The gas thus compressed is discharged into the case 10 through the discharge holes 45*a* and 45*b* in the bearings 22*a* and 22*b*, and then returned to the refrigerating cycle through discharge tube 46.

Figure 6:
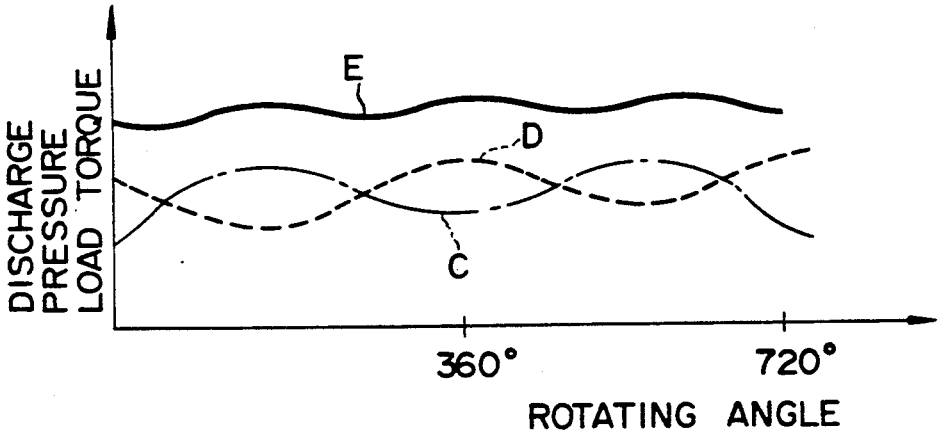

FIG. 6 shows the relationship between the rotational angle of the rotating rod 24 and load torque and discharge pressure of the compressor. A dot and dash line C represents the discharge pressure and load torque generated by the compressed gas discharged through the discharge hole 45*a*, which change, drawing a sine curve, in accordance with the rotation of the rod 24. A broken line D denotes the discharge pressure and load torque generated by the compressed gas discharged via the discharge hole 45*b*, which change, drawing a sine curve, as the rod 24 rotates. As described above, the starting ends 38*a* and 38*b* of the first and second spiral grooves 30*a* and 30*b* on the rotating rod 24 are set apart from each other by 180° in the circumferential direction of the rod 24. The gases compressed in the operating chambers 42 and 44 are alternately discharged from the discharge holes 45*a* and 45*b* every time the rod 24 rotates 180° degrees. The curve C has the same amplitude and cycle as those of the curve D, but is different in phase by 180° from the curve D. Therefore, variations in the discharge pressure and the load torque of the compressor, which are the sum of the discharge pressures and the load torques represented by the curves C and D, can be reduced as shown by a solid line E in FIG. 6.

According to the compressor having the abovedescribed arrangement, the refrigerant gas sucked into the middle portion of the cylinder 20 is compressed while being fed in two opposite directions, that is, to the first and second discharge ends of the cylinder. When the gas is being compressed, therefore, thrust forces heading from the first discharge end of the cylinder to the middle thereof and from the second discharge end of the cylinder to the middle thereof act on the rotating rod 24, and they are balanced with each other because they are equal to each other. This can prevent the rod 24 from being displaced to push its end faces against the bearings. Therefore, during the operation of the compressor, friction between the rotating rod 24 and the bearings 22*a* and 22*b* can be reduced, thereby improving the operating efficiency of the compressor.

If the compression capacity of the compressor is fixed, the pitches of each of the spiral grooves and the blades of the compressor, according to this embodiment, can be made smaller than those of a compressor which has a single spiral groove extending from one end to the other end of the rotating rod and a blade fitted into the groove. Therefore, with this embodiment, stress acting on each of the blades 40*a* and 40*b* can be reduced, so that abrasion of the blades ca be reduced and each blade smoothly moves in the corresponding groove.

The starting ends 32*a* and 32*b* of the first and second spiral grooves 30*a* and 30*b* are set apart from each other in the rotating direction of the rod 24. Therefore, the variation in the load torque and discharge pressure of the compressor can be greatly reduced, thereby decreasing the vibration and noise of the compressor to a greater extent. In addition, the starting ends 32*a* and 32*b* of the spiral grooves are set apart from each other in the axial direction of the rotating rod 24, particularly in the direction in which both of the spiral grooves come nearer to each other. As compared with the conventional compressor having a single spiral groove, therefore, the rotating rod can be made shorter to thereby make the compressor smaller in size.

The Oldham's mechanism 50 for transmitting the rotational force of the cylinder 20 to the rod 24 comprises two through-holes bored in the rod 24, and the Oldham's pin and slider inserted through these through-holes. As compared with the conventional Oldham's ring, therefore, the Oldham's mechanism 50 needs a smaller space and this helps the compressor be made compact. Further, the Oldham's mechanism 50 needs no Oldham's ring. Thus, even when the smaller-diameter portions of the rotating rod 24 are made larger in diameter to make smaller those spaces which are defined between the inner circumference of the cylinder and the outer circumferences of the smaller-diameter portions of the rod 24, the mechanism 50 can be easily arranged in the cylinder. Even in the above case, the mechanism 50 enables the Oldham's pin and slider to be sufficiently displaced in accordance with the eccentricity e of the rotating rod 24.

The Oldham's mechanism 50 is simple in construction wherein the Oldham's pin and slider are inserted through the through-holes in the rotating rod. This simple construction enables the compressor to be more easily manufactured, particularly allowing the Oldham's mechanism to be more easily incorporated into the compressor.

It should be understood that the present invention is not limited to the above-described embodiment but that various changes and modifications can be made without departing from the spirit and scope of the present invention.

It is most preferable that the starting ends 32*a* and 32*b* of the first and second spiral grooves 30*a* and 30*b* are set apart from each other by 180° in the rotating direction of the rod 24. However, even when they are set apart by a value smaller than 180°, the variations in the load torque and discharge pressure of the compressor change can be smaller than those in the case where the starting ends are not set apart from each other. Further, turns and pitches of the first spiral groove may be different from those of the second spiral groove. Even in this case, the thrust forces acting on the rotating rod, as well as the load torque and discharge pressure of the compressor, can be reduced.

The compressor of the present invention can be applied to other systems as well a the refrigerating cycle.

Additional advantages and modifications will readily occur to those skilled in the art. Therefore, the invention in its broader aspects is not limited to the specific details, and representative devices, shown and described herein. Accordingly, various modifications may by without departing from the spirit or scope of the general inventive concept as defined by the appended claims and their equivalents.

What is claimed is:

1. A fluid compressor comprising:

a cylinder having first and second discharge ends;

a columnar rotating body located in the cylinder to extend in an axial direction of the cylinder and be eccentric thereto, and rotatable while part of the rotating body is in contact with an inner circumference of the cylinder, said rotating body having first and second spiral grooves on an outer circumference thereof, said first groove having a first starting end located substantially in the middle of the rotating body, extending from the first starting end toward the first discharge end of the cylinder, and having pitches gradually narrowed with distance from the first starting end of the first discharge end of the cylinder, said second groove having a second starting end located substantially in the middle of the rotating body, extending from the second starting end toward the second discharge end of the cylinder, and having pitches gradually narrowed with distance from the second starting end to the second discharge end of the cylinder, said first and second grooves being turned in directions opposite to each other, and said first and second starting ends being set apart from each other by a certain angle in a circumferential direction of the rotating body, said first starting end at least partially overlapping said second starting end in the axial direction of the rotating body;

first and second spiral blades fitted into the first and second grooves to be slidable in a radial direction of the rotating body, respectively, having outer circumferential surfaces in contact with the inner circumference of the cylinder, and dividing a space between the inner circumference of the cylinder and an outer circumference of the rotating body into a plurality of operating chambers;

means for guiding operating fluid into that area of the space which is adjacent to the first and second starting ends of the first and second grooves; and drive means for rotating the cylinder and rotating body synchronously with each other so as to feed the operating fluid, introduced into said area through the guide means, to the first and second discharge ends of the cylinder through the operating chambers and to discharge the operating fluid outside from the first and second discharge ends.

2. A fluid compressor according to claim 1, wherein said first and second starting ends are set apart from each other by 180° in the circumferential direction of the rotating body.

3. A fluid compressor according to claim 1, wherein said first spiral groove has the same number of turns as that of said second spiral groove.

4. A fluid compressor according to claim 1, wherein said first and second spiral grooves have the same pitches.

5. A fluid compressor according to claim 1, wherein said guide means includes a suction port opened to the outer circumference of the rotating body and located between the first and the second spiral grooves, and a suction passage formed in the rotating body and having one end communicating with the suction port and an other end opened outside the cylinder.

6. A fluid compressor according to claim 5, wherein said suction port is formed at that area on the outer circumference of the rotating body which is defined by the first turn of the first spiral groove and the first turn of the second spiral groove.

7. A fluid compressor according to claim 1, wherein said guide means includes first and second suction ports opened to the outer circumference of the rotating body and located between the first and the second spiral grooves, and a suction passage having one end communicating with the first and second suction ports and an other end opened outside the cylinder.

8. A fluid compressor according to claim 7, wherein said first suction port is located between the first starting end and a terminal end of the first turn of the first spiral groove, while said second suction port is located between the second starting end and a terminal end of the first turn of the second spiral groove.

9. A fluid compressor according to claim 1, wherein said drive means includes motor means for rotating the cylinder, and means for transmitting the rotation of the cylinder to the rotating body to rotate the body synchronous with the cylinder, said transmitting means having an Oldham's mechanism.

10. A fluid compressor comprising:

a cylinder having first and second discharge ends;

a columnar rotating body located in the cylinder to extend in an axial direction of the cylinder and be eccentric thereto, and rotatable while part of the rotating body is in contact with an inner circumference of the cylinder, said rotating body having first and second spiral grooves on an outer circumference thereof, said first groove having a first starting end located substantially in the middle of the rotating body, extending from the first starting end toward the first discharge end of the cylinder, and having pitches gradually narrowed with distance from the first starting end to the first discharge end of the cylinder, said second groove having a second starting end located substantially in the middle of the rotating body, extending from the second starting end toward the second discharge end of the cylinder, and having pitches gradually narrowed with distance from the second starting end to the second discharge end of the cylinder, said first and second grooves being turned in directions opposite to each other, and said first and second starting ends being set apart from each other by a certain angle in a circumferential direction of the rotating body;

first and second spiral blades fitted into the first and second grooves to be slidable in a radial direction of the rotating body, respectively, having outer circumferential surfaces in contact with the inner circumference of the cylinder, and dividing a space between the inner circumference of the cylinder and an outer circumference of the rotating body into a plurality of operating chambers;

means for guiding operating fluid into that area of the space which is adjacent tot eh first and second starting ends of the first and second grooves; and drive means for rotating the cylinder and rotating body synchronously with each other so as to feed the operating fluid, introduced into said area through the guide means, to the first and second discharge ends of the cylinder through the operating chambers and to discharge the operating fluid outside from the first and second discharge ends, wherein said drive means includes motor means for rotating the cylinder, and means for transmitting the rotation of the cylinder to the rotating body to rotate the body synchronous with the cylinder, said transmitting means having an Oldham's mechanism.

11. A fluid compressor according to claim 10, wherein said Oldham's mechanism includes first and second through-holes formed, perpendicular to each other, in the rotating body and extending in the radial direction of the body, a first pin member loosely passed through the first through-hole, extending in the radial direction of the cylinder, and fixed to the cylinder, and a second pin member having a third through-hole in which the first pin member is slidably inserted and which is parallel to the first through-hole, said second pin member being slidably inserted into the second through-hole and movable in the axial direction of the first pin member while being kept perpendicular to the first pin member.

12. A fluid compressor according to claim 11, wherein said first through-hole has a diameter larger than the diameter of the first pin member by $2e$ or more, where e represents a distance by which the rotating body is eccentric to the center axis of the cylinder.

* * * * *